US007942794B2

(12) United States Patent
Nardone

(10) Patent No.: US 7,942,794 B2
(45) Date of Patent: May 17, 2011

(54) TRAINING DEVICE

(76) Inventor: Jennifer R. Nardone, Quezon (PH)

( * ) Notice: Subject to any disclaimer, the term of this patent is extended or adjusted under 35 U.S.C. 154(b) by 481 days.

(21) Appl. No.: 11/993,365

(22) PCT Filed: Jun. 19, 2006

(86) PCT No.: PCT/IB2006/003850

§ 371 (c)(1),
(2), (4) Date: Dec. 20, 2007

(87) PCT Pub. No.: WO2007/039831

PCT Pub. Date: Apr. 12, 2007

(65) Prior Publication Data

US 2010/0160126 A1 Jun. 24, 2010

(30) Foreign Application Priority Data

Jun. 20, 2005 (DE) ..... 20 2005 009 651 U

(51) Int. Cl.
*A63B 26/00* (2006.01)

(52) U.S. Cl. ..... 482/140

(58) Field of Classification Search ..... 482/140, 482/91, 907, 139, 126, 104, 148, 51, 67, 482/92–93, 132, 136–137
See application file for complete search history.

(56) References Cited

U.S. PATENT DOCUMENTS

| | | | | |
|---|---|---|---|---|
| 4,848,742 | A * | 7/1989 | Lindley et al. | 482/142 |
| 5,931,768 | A * | 8/1999 | Amesquita | 482/140 |
| 6,258,016 | B1 * | 7/2001 | Kuo | 482/142 |
| 6,283,900 | B1 * | 9/2001 | Tornabene | 482/122 |
| 6,544,151 | B2 * | 4/2003 | Tornabene | 482/122 |
| 6,656,095 | B2 * | 12/2003 | Fernandez | 482/142 |
| 6,971,977 | B1 * | 12/2005 | Chen | 482/140 |
| 2003/0100415 | A1 * | 5/2003 | Augustine et al. | 482/140 |
| 2004/0033873 | A1 | 2/2004 | Van Straaten | |
| 2005/0075224 | A1 * | 4/2005 | Lin | 482/130 |
| 2005/0075225 | A1 * | 4/2005 | Shin | 482/130 |
| 2005/0181916 | A1 * | 8/2005 | Frost et al. | 482/140 |
| 2006/0205575 | A1 * | 9/2006 | Ho | 482/140 |
| 2007/0184939 | A1 * | 8/2007 | Arsenault | 482/92 |

* cited by examiner

*Primary Examiner* — Lori Baker
(74) *Attorney, Agent, or Firm* — Adam K. Sacharoff; Much Shelist

(57) ABSTRACT

The invention relates to a training device (2) which comprises a base body (4) having a bearing surface (6) which is embodied in such a manner that the back of a user can be placed on the bearing surface (6) when in use. The base body (4) is mounted on or is embodied in such a manner with the bearing surface (6) that it can pivot from a first position, wherein the back of the user, who is sitting, is placed on the bearing surface (6) when in use, into a second position, wherein the bearing surface (6) is pivoted from a first position into the horizontal direction.

3 Claims, 6 Drawing Sheets

TRAINING DEVICE

BACKGROUND OF THE INVENTION

The present invention relates to a home training device, and in particular to a home training device for strengthening the truncal muscles.

Training devices for strengthening the truncal muscles are well known in a wide range of variations. Apart from the professional devices which are used in rehabilitation and in gyms, there is also a great number of home training devices such as rowing machines etc. Most of these training devices are primarily aimed at training the abdominal muscles. There is a lack of home training devices that in particular also strengthen the dorsal muscles to a high degree. One substantial aspect of training devices in general, and especially of home training devices focusing on the dorsal muscles, is how to safely and reliably guide the motion so that no malpositions or improper motions occur during training.

SUMMARY OF THE INVENTION

Accordingly, the object of the present invention is to provide a home training device for training the truncal muscles, and in particular the dorsal muscles, which training device ensures safe motion guidance while being easy and economical to manufacture.

According to the invention, this object is achieved by a training device comprising a base body with a bearing surface that is formed in such a way that in operation a user can bear his or her back against the bearing surface, wherein the base body with the bearing surface is supported or configured in such a way that it can be pivoted from a first position, in which the sitting user can bear his or her back against the bearing surface, to a second position, in which the bearing surface has been pivoted from the first position towards a horizontal position.

Preferably, the bearing surface is pivoted from its substantially vertical position towards the horizontal position not just by tilting the bearing surface about a rotational axis that is substantially disposed in the bearing surface. Rather, it is favorable if the bearing surface is pivoted upwards, backwards and into a horizontal position along a curved path from the substantially horizontal position. In this context it should be noted that, where directions such as top, bottom, front, back are indicated in the following description, these are given as in operation, as seen by a user during training. In particular, it is favorable if the bearing surface is pivoted, from the substantially vertical position, upwards, backwards and towards the horizontal position, or completely into the horizontal position, along a circular arc. In that process, the user pushes himself or herself up by pressing his or her feet against the underlying surface, thereby moving the bearing plate backwards along this curved path. In that process, the user automatically tenses his or her muscles, and in particular the lower dorsal muscles.

There may be handles provided, and in particular two handles laterally adjacent to the bearing surface. In operation, when the user is in a sitting position, the handles are preferably located in the vicinity of the lower end of the bearing surface, in a position offset forward from the bearing surface by about 15-25 cm.

The bearing surface may be padded on its bearing side. The bearing surface may be curved to fit the natural shape of the back, in particular with a lordotic-support-type convex bulge provided in the vicinity of the user's lumbar vertebrae, and with the bearing surface bending increasingly backwards from there in an upward direction towards the cervical vertebrae. In this way, not only the long extensors of the back can be trained, but also, in particular, the shorter dorsal muscles which are located between individual vertebral bodies.

The base body may have a plate-shaped bearing element. One substantial selling proposition for home training devices is their capability of being folded to relatively small dimensions when they are not in use, so that they can be easily stored. In principle, the base body is the largest single component of the training device discussed here. A plate-shaped design of the base body, or of its largest element, i.e. the bearing surface, is a first step in this direction.

The base body with the bearing surface may be rotatably supported. In particular, the base body is supported so as to be rotatable about a rotational axis located in a plane which is substantially parallel to the plane of the bearing surface and, when in operation, is oriented at substantially right angles with the spine. For the bearing surface to perform its motion along the previously described curved path it is favorable to provide the rotational axis behind the bearing surface, at a certain distance from the bearing surface.

Alternatively, the base body may have a curved rest-on element by means of which the training device, when in operation, stands on an underlying surface, and which is configured in such a way that the training device is pivoted, or can be rolled, from its first position to its second position when subjected to a pivoting motion along the curvature of the curved rest-on element on the underlying surface. For example, the training device may, similar to a rocking chair, comprise two rockers that are substantially identical in shape and on which it can perform its pivoting motion. It may be favorable to make these rockers or the rest-on element from a material that enhances friction or that is coated with such a material; it is conceivable, for example, to make the rockers or the rest-on surfaces of the rest-on element from a rubber-like material.

Another alternative solution is to arrange the base body so that it can slide along appropriately curved rails, which in operation firmly rest on an underlying surface and define a pivot path for the base body or the bearing element, as described above.

As has been mentioned, the curved pivot path may preferably be curved in the shape of a circular arc. This circular-arc shaped curvature has the advantage of being easier to produce. In particular, the curved rest-on element may be curved in the shape of a circular arc. If necessary from a training perspective, the curvature may also be adapted to an optimal training profile and may, for example, be shaped in such a way that it counters with a particularly strong counterforce the user's motion at its beginning.

The curved rest-on element preferably has two curved bent tubes. The corresponding design, which resembles the rockers of a rocking chair, has been mentioned above.

Preferably, the training device has an adjustment device by means of which the intensity of training, or the amount of force required for training, can be adjusted. One particularly simple way of setting a larger or smaller amount of force uses the difference in height that is covered when pivoting the bearing element upwards and backwards to the horizontal position. The adjustment device is preferably configured to permit adjusting the curvature path relative to the bearing surface. Thus, other pivot path layouts can be set for training. If the bearing element is supported on a rotational axis, the adjustment device can be adjusted by changing the distance between the bearing surface and the rotational axis.

If the training device has the previously mentioned bent tubes as curved rest-on elements, the adjustment device preferably has one pivot bearing on each first end of an bent tube, and a variable fixing device, with the curvature of the bent tube substantially located between the pivot bearing and the variable fixing device. In other words, there is a pivot bearing disposed on one side of the curvature of the rest-on element so that the rest-on element, i.e., for example, the bent tube, can be pivoted. At the other end of the curvature, there is provided a fixing device so that the rest-on element that has been pivoted about its pivot axis can be fixed in the selected position. Positioning the pivot element and the fixing device at the two opposite end portions of the curvature, respectively, permits absorbing the arising forces by components having relatively weak dimensions, in particular by a fixing device having relatively weak proportions. In principle, however, it is also conceivable to provide the fixing device on the same side as the pivot bearing.

Each handle may be arranged to be continuous from an bent tube. Preferably, a handle is formed in such a way that it can be inserted into the corresponding end of an bent tube. On the one hand, the plug-in design of the handle and the bent tube permits very simple and efficient transmission of forces from the handle to the base body, and very simple mounting of the handle on the base body. On the other hand, the plug-in connection permits releasing the handle from the base body, thus facilitating disassembly and/or storage of the training device. For example, there may be provided a click stop to prevent the handle from inadvertently slipping out of the bent tube. Alternatively, it is also possible to form the handle integrally with the bent tube.

The base body is preferably configured to be foldable in such a way that its mounting parts or its essential mounting parts are foldably attached to it and/or to the plate-shaped bearing element so that they can be folded onto the plate-shaped bearing element for storing the training device. In particular, the training device has at least one folding hinge by means of which the bent tube can be folded to a plane substantially parallel to the plane of the bearing surface.

The folding hinge may be provided at the same end of the bent tube as the pivoting hinge. The folding hinge and pivoting hinge are twisted relative to each other by 90° in two parallel planes.

Preferably, further provided on the training device is an additional weight serving to increase the amount of force required for training. In particular, the additional weight is mountable to the lower or hip-side end of the bearing surface.

BRIEF DESCRIPTION OF THE DRAWINGS

The invention and the embodiments of the invention will subsequently be described using examples of the embodiments.

DETAILED DESCRIPTION OF THE INVENTION

Figure 1:
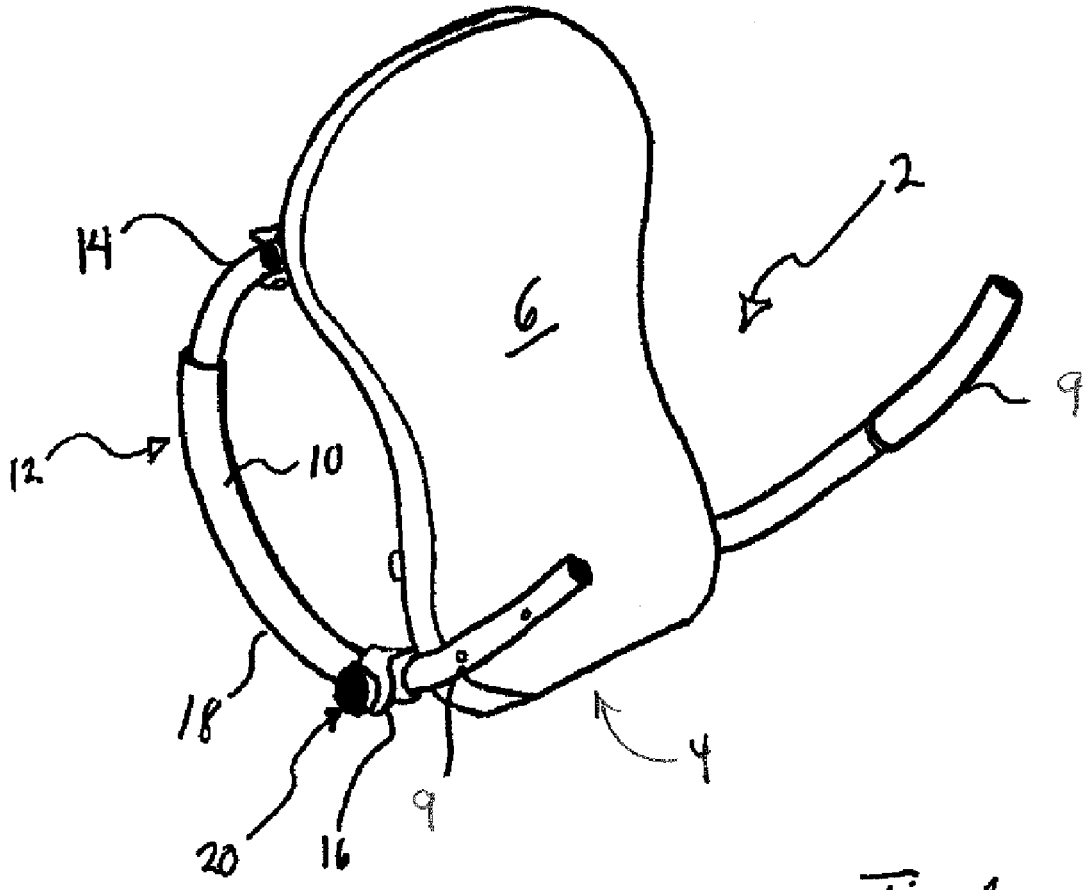
FIG. 1 shows a front view of a training device of the invention.
Figure 6:
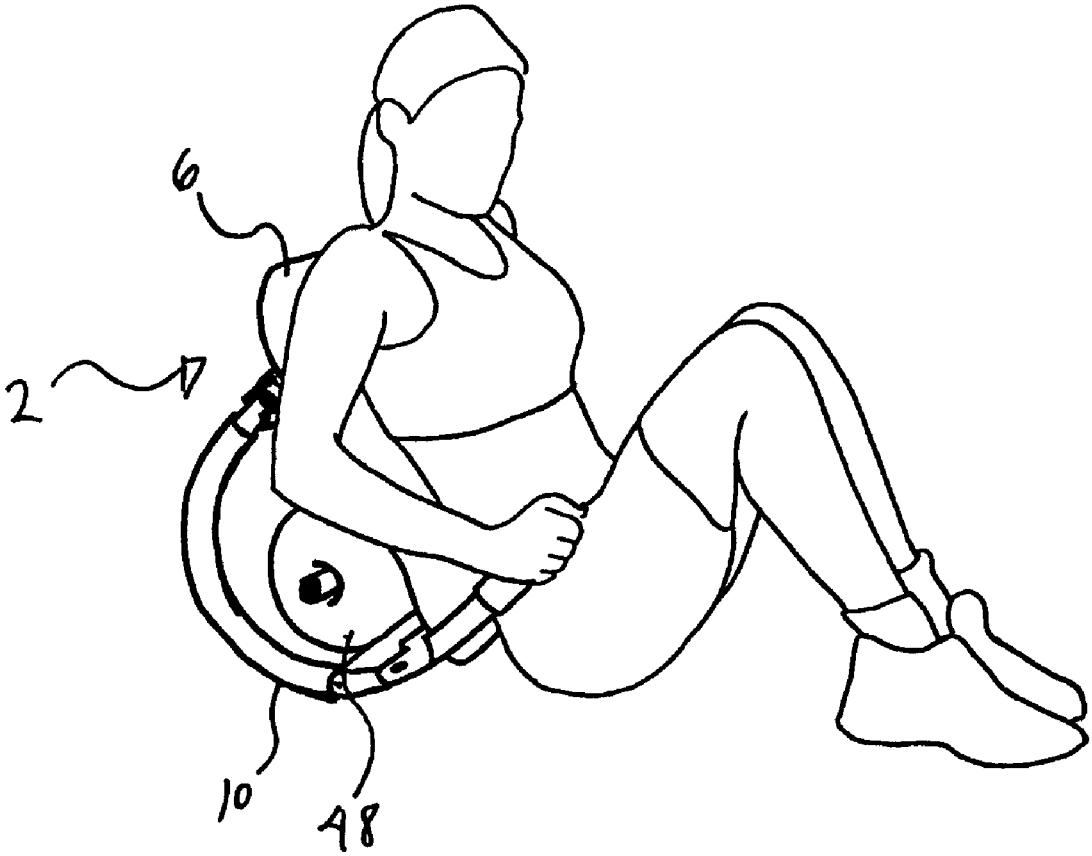
FIG. 6 shows a person exercising with the training device of the invention in a first position.

FIG. 1 shows a training device 2 comprising a base body 4 with a bearing surface 6. In operation, as shown in FIG. 6, a user 8 can bear his or her back against the bearing surface 6. There are two handles 9 provided laterally adjacent to the bearing surface. Each handle 9 is connected to a curved bent tube 10. The bent tubes 10 form a rest-on element 12 of the base body 4. The bent tubes 4 are formed in a substantially tubular curved shape in the area between a first mounting point at a first end 14 and a second mounting point at a second end 16. An anti-slip coating is provided both in the rest-on portion 18 of the bent tubes 10 and in the portion of the handles 8.

Figure 2:
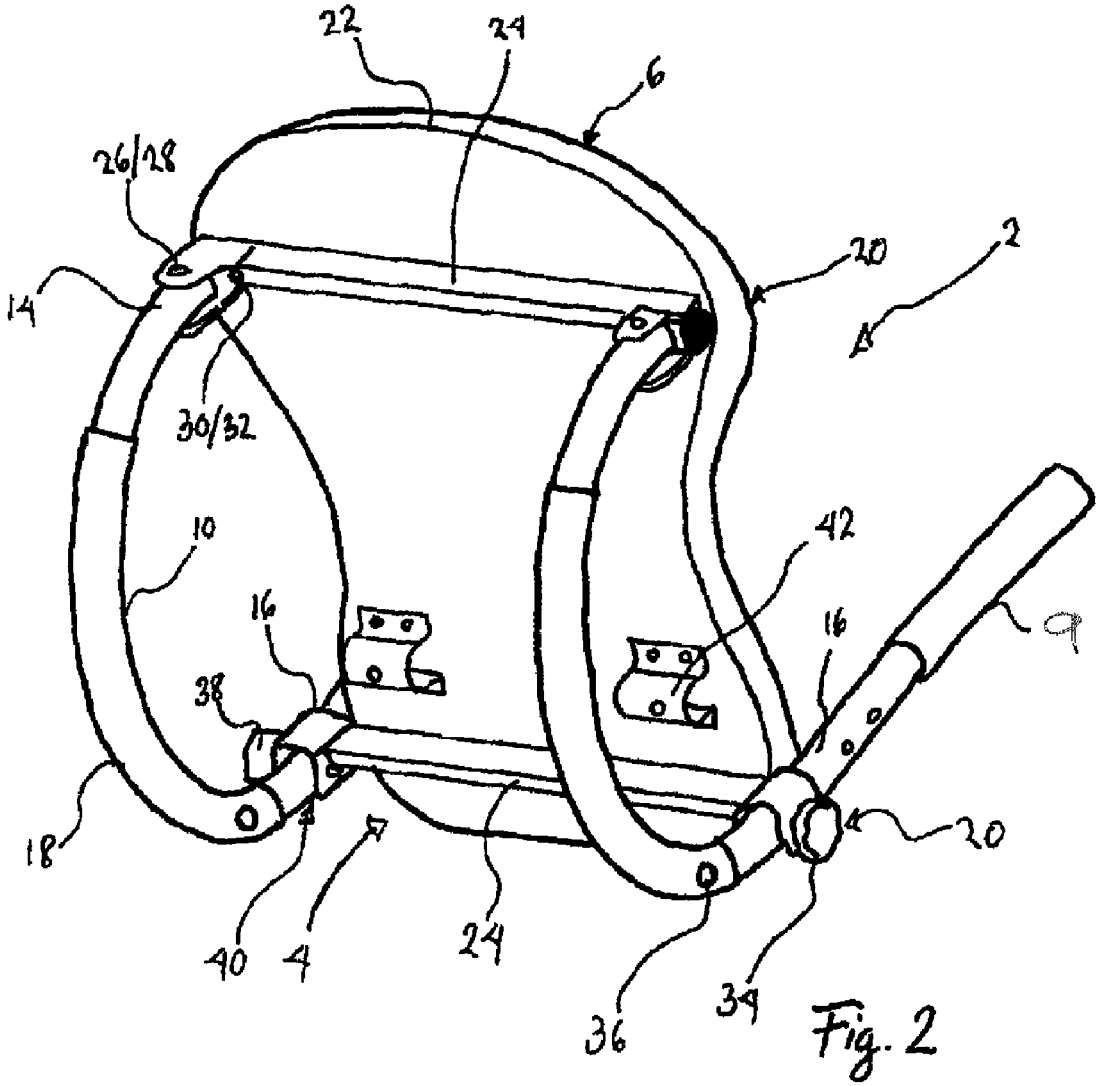
FIG. 2 shows a rear view of a training device of the invention according to another embodiment.

FIG. 2 is a view similar to FIG. 1 but shows a second and slightly different embodiment. The differences are substantially in the adjustment device 20, which will be explained below.

Throughout the various views, the same reference numerals refer to the same or to corresponding elements. Any specific detail solution shown with reference to one of the figures may generally also be transferred to the embodiments in the other figures.

In the view shown in FIG. 2 it can be seen that the base body 4 has a plate-shaped bearing element 22 on which the bearing surface 6 is provided. On the back of the plate-shaped element 22 in this embodiment, bent tubes 10 are connected respectively by means of a stiffening beam 24. In particular, it can be seen that the bent tubes 10 can be folded about a first rotational axis 26 forming a folding hinge 28, and can further be pivoted in the plane defined by the bent tube 10 by means of a second rotational axis 30 forming a pivot bearing 32. A variable fixing device 34 permits the bent tube 10 to be correspondingly fixed to the second end 16, and thus permits the bent tube 10 to be adjusted in the plane of the bent tube 10.

The variable fixing device preferably has a bolt that can be inserted into corresponding openings 36 on the bent tubes 10 and be fixed there, for example, by means of screws, by spring-loading, etc., so that it cannot come loose on its own. The embodiment of FIG. 2 comprises a turning knob 38 as a control element. The arcuous tube itself is guided in a U-shaped channel 40 and is fixed in the channel 40 by the variable fixing device 34.

It can be seen that the pivot bearing 32 and the folding hinge 28 are disposed substantially at a 90° angle with each other. The channel 40 at the same time also fixes the bent tube 10 to its operating position.

Preferably, the fixing is such that in operation the bent tubes 10 are fixed to a slightly outwardly pivoted position, so that lateral stability is improved by a wider "track".

Further to be seen in FIG. 2 are two mounting brackets 42 which are connected to the plate-like bearing element 22 and to which additional weights 48 may be mounted.

Figure 3:
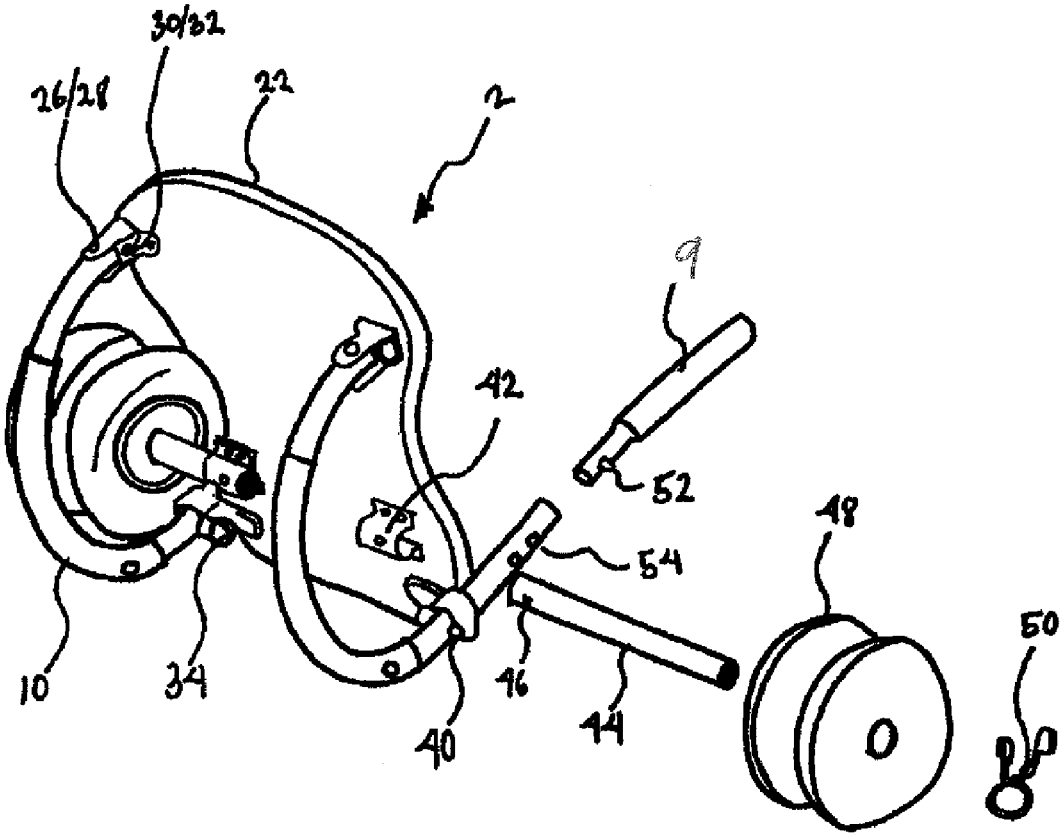
FIG. 3 shows a partly exploded rear view of the training device of the invention of FIG. 1.

In particular, as can be seen in FIG. 3, the additional weights 48 may be mounted on a tube or bar 44, which can be fixed in the mounting bracket 42 by, for example, a click-in lock 46. The additional weight 48 in the shown embodiment is a body made of a plastic material, for example, which can be filled and/or drained. This allows the additional weight 48 to be filled with water, sand, etc. on site. In operation, the additional weight 48 itself is fixed to the bar 44 by means of a clamping lock 50. The bracket 42 can be disposed closer to the bottom than the position shown in FIG. 3 or FIG. 2 to create more favorable lifting conditions, so that a maximum increase in intensity can be achieved by means of the additional weight 48.

Further, it can be seen in FIG. 3 that the handle 8 is insertably connected to the bent tube 10. In operation, a click-in device 52 fixes the handle to a corresponding opening 54.

It can also be seen in FIG. 3 that the pivot bearing 32 is disposed between the folding hinge 28 and the plate-like bearing element 22. It is also possible, and may be preferable for better folding, to provide the folding hinge 28 between the pivot bearing 32 and the plate-like bearing element 22. This sequence is not shown in the figures. It is also possible to provide one bent tube 10 with the sequence of hinges 28, 32 shown in the figures and to provide the other bent tube 10 with the reverse sequence. Thus, it is possible to fold one bent tube so that it immediately bears against the plate-like bearing element 22 and to fold the second bent tube 10 into a position parallel to the first bent tube. Both bent tubes 10 can thus be folded substantially directly under the plate-like bearing element 22, which permits very compact folding oft the training device 2.

Figure 4:
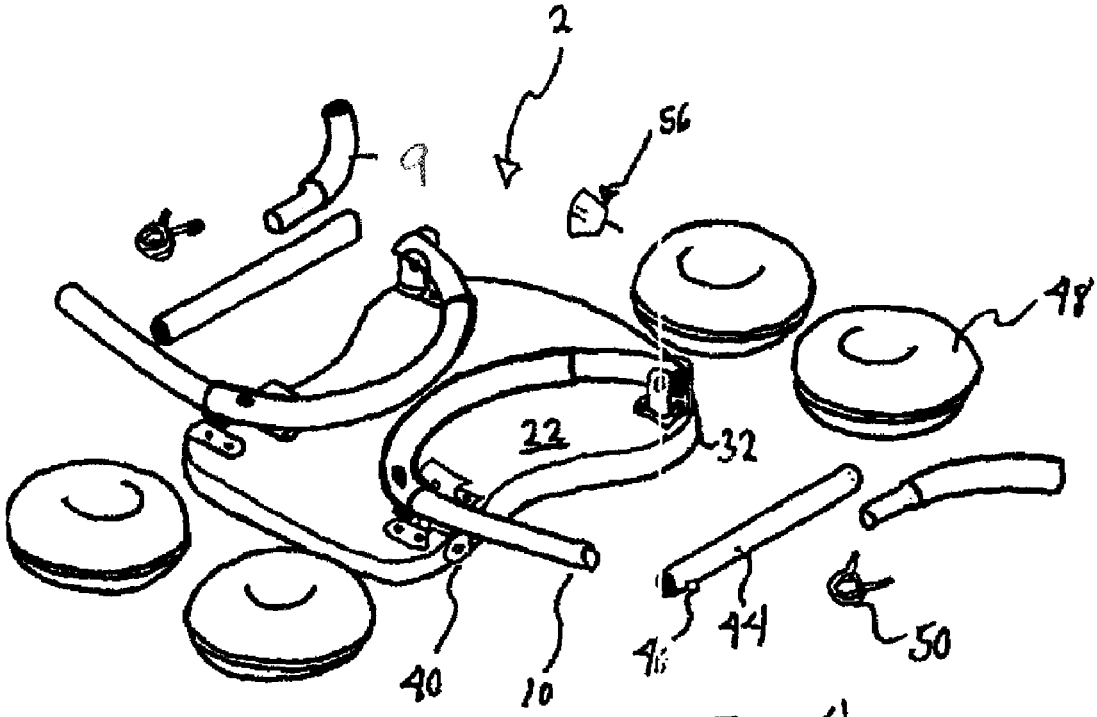
FIG. 4 shows the training device of the invention of FIG. 1 in a disassembled and partly folded arrangement.

FIG. 4 shows the folded position. It can also be seen that the bent tubes 10 have been removed from the channel 40 for folding. This is simply done by pivoting the bent tube, substantially within its plane, about the pivot bearing 32. A small funnel 56 may be provided for filling the additional weights 48.

Figure 5:
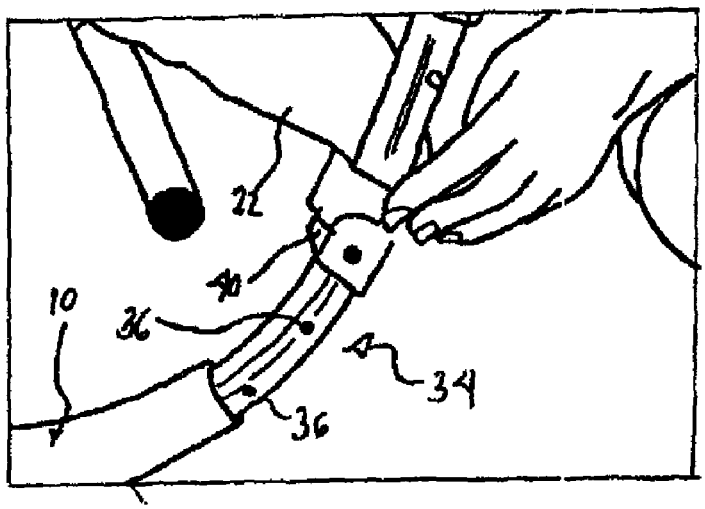
FIG. 5 shows the detail of the adjustment device in the training device of the invention.

FIG. 5 shows a detail view of the variable fixing device 34. In particular, a number of openings 36 can be seen into which a corresponding locking pin can be inserted. The channel 40 can also be seen.

FIG. 6 shows the training device 2 in operation. The sitting user can be seen bearing her back against the bearing device 6. In FIG. 6, the "first position" of the training device 2 is shown. In this first position, the bearing surface 6 is substantially vertical, the term "vertical" being intended in a very broad sense in this context.

Figure 7:
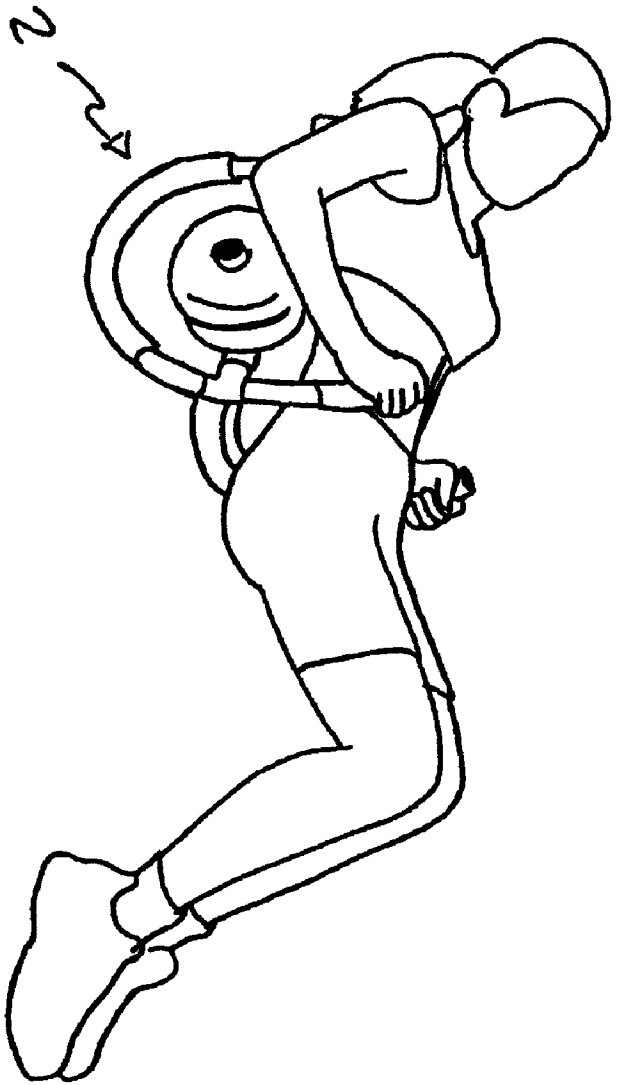
FIG. 7 shows a view similar to the one in FIG. 6 in a second position.

In FIG. 7, the training device 2 can be seen in the "second position", in which the training device 2 has substantially been pivoted towards a horizontal position from its first position of FIG. 6. To FIGS. 6 and 7 too, it applies that training efficiency may be increased by downward displacing the additional weights 48 and/or that smaller weights may be used.

The invention claimed is:

1. A training device comprising:

a) a frame having two opposing sides, each of the two opposing sides having:
   i) a curved portion located on a first end thereof;
   ii) a plastic sleeve located on a curved portion; and
   iii) a holding stick inserted into a second end thereof;

b) a back cushion, an end of the curved portion of each of the two opposing sides of the frame is connected to one of two opposing sides of a top portion of a back of the back cushion, one of two opposing sides of a lower portion of the back of the back cushion is adjustably connected to each of the two opposing sides of the frame between the curved portion and the holding stick; and c) a loading shaft connected to the back of the back cushion and selectively having a weight positioned on each of two opposing ends thereof.

2. The training device according to claim 1, wherein each of the two opposing sides of the frame have a plurality of through holes, the lower portion of the back of the back cushion is selectively connected to one of the plurality of through holes of each of the two opposing sides of the frame.

3. The training device according to claim 1, wherein each of the two opposing sides of the frame have a plurality of wedging holes, each holding stick is selectively connected to one of the plurality of wedging holes.

* * * * *